United States Patent [19]

Gillhaus et al.

[11] Patent Number: 4,518,352

[45] Date of Patent: May 21, 1985

[54] INDUSTRIAL OVEN WITH AIR RECIRCULATION FOR HEAT TREATING PROCESSES

[75] Inventors: Horst Gillhaus, Dortmund-Loh; Fritz Hegewaldt, Herdecke; Wolfgang Faber, Waltrop, all of Fed. Rep. of Germany; Jürgen Baer, Mägenwil; Ernst Toplak, Oberrohrdorf, both of Switzerland

[73] Assignee: Brown, Boveri & Cie. AG., Mannheim-Kaefertal, Fed. Rep. of Germany

[21] Appl. No.: 649,151

[22] Filed: Sep. 10, 1984

Related U.S. Application Data

[63] Continuation of Ser. No. 418,552, Sep. 15, 1982, abandoned.

[30] Foreign Application Priority Data

Sep. 16, 1981 [DE] Fed. Rep. of Germany ..... 3136667

[51] Int. Cl.[3] ..... F27D 7/04; F27B 9/04; F26B 19/00

[52] U.S. Cl. ..... 432/199; 34/222; 34/231; 432/152

[58] Field of Search ..... 432/5, 152, 199; 34/219, 222, 231

[56] References Cited

U.S. PATENT DOCUMENTS

| | | | |
|---|---|---|---|
| 1,762,879 | 6/1930 | Mueller | 34/222 |
| 1,964,115 | 6/1934 | Goodall | 34/222 |
| 2,362,847 | 11/1944 | O'Neil | 34/231 |
| 3,188,068 | 6/1965 | Schmidt | 432/199 |
| 4,408,986 | 10/1983 | Soraya et al. | 432/199 |

*Primary Examiner*—John J. Camby
*Attorney, Agent, or Firm*—Laurence A. Greenberg; Herbert L. Lerner

[57] ABSTRACT

Industrial oven providing air recirculation for heat treatment processes having temperature uniformity within a charge to be treated, including oven walls, spacers disposed between the oven walls for supporting the charge at a distance from the oven walls defining a space therebetween and for allowing a recirculated hot air flow around the charge from all sides, and elements disposed in the space between the charge and the oven walls for influencing the air flow.

10 Claims, 6 Drawing Figures

III
6
3
2
4
16
17
13
13
5
29
1
1
1
22
11
III 13
14
17
1
16
20
16
11
29
15
16
13

INDUSTRIAL OVEN WITH AIR RECIRCULATION FOR HEAT TREATING PROCESSES

This application is a continuation of application Ser. No. 418,552, filed Sept. 15, 1982, now abandoned.

The invention relates to an industrial oven with air recirculation for heat treatment processes with high temperature uniformity within a charge to be treated, the charge being placed or stacked by means of spacers, in such a manner that the recirculated hot air flows around the charge from all sides.

Such industrial ovens have become known as large-chamber ovens with air recirculation (see BBC Brochure EO 4088 D-1072.2.1). Through heavy-duty air circulating units and appropriate mechanical design of the ovens, short heat up times and great temperature uniformity can be achieved. Increasing the flow velocity for shortening the heat up time, however, leads to overtemperatures in the charge, so that increasing the flow velocity for shortening the heat up time and for reducing the temperature differences during the heat up, and also during the annealing treatment, turns out to be a disadvantage in conventional ovens.

It is accordingly an object of the invention to provide an industrial oven with air recirculation for heat treatment processes, which overcomes the hereinafore-mentioned disadvantages of the heretoforeknown devices of this general type, and to improve the chamber oven in such a way that an increase of the flow velocity is made possible while at the same time shortening the heat up time and reducing the temperature differences during heat up and during the annealing treatment.

With the foregoing and other objects in view there is provided, in accordance with the invention, an industrial oven providing air recirculation for heat treatment processes having temperature uniformity within a charge to be treated, comprising oven walls, spacers disposed between the oven walls for supporting or stacking the charge at a distance from the oven walls defining a space therebetween and for allowing a recirculated hot air flow around the charge from all sides, and elements such as obstacles, baffles or the like disposed in the space between the charge and the oven walls for influencing the air flow.

The placement of elements influencing the air flow in the space between the charge and the oven walls, prevents overtemperatures from occuring in the charge at any time, anywhere. Maintaining the desired temperature is necessary because homogenizing aluminum and aluminum alloys is only carried out at a few degrees K. below the melting point, so that only small overtemperatures would have already caused damage.

In accordance with another feature of the invention, the oven walls have inner surfaces, and the elements influencing the air flow are rigidly or movably disposed in the space between the inner surfaces of the walls and the charge. The movable elements may be hinged.

In accordance with a further feature of the invention, the elements influencing the air flow have a shape adapted to the shape of the charge. This is done so that they practically represent a mirror element of the outer surface of the charge.

In accordance with a concomitant feature of the invention, the air flow is in a given direction, and the elements influencing the air flow are disposed perpendicular to the given air flow direction.

Other features which are considered as characteristic for the invention are set forth in the appended claims.

Although the invention is illustrated and described herein as embodied in an industrial oven with air recirculation for heat treatment processes, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings, in which.

Figure 1:
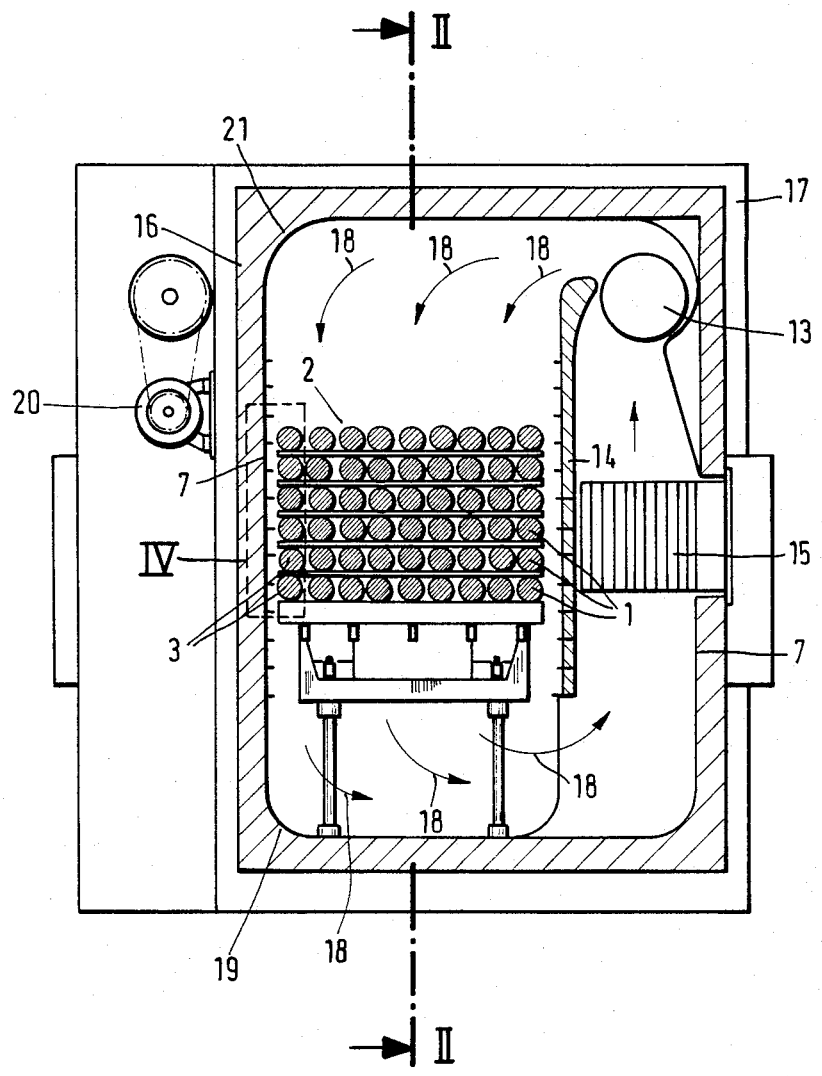
FIG. 1 is a diagrammatic, cross-sectional view of an industrial oven for heat treatment.
Figure 2:
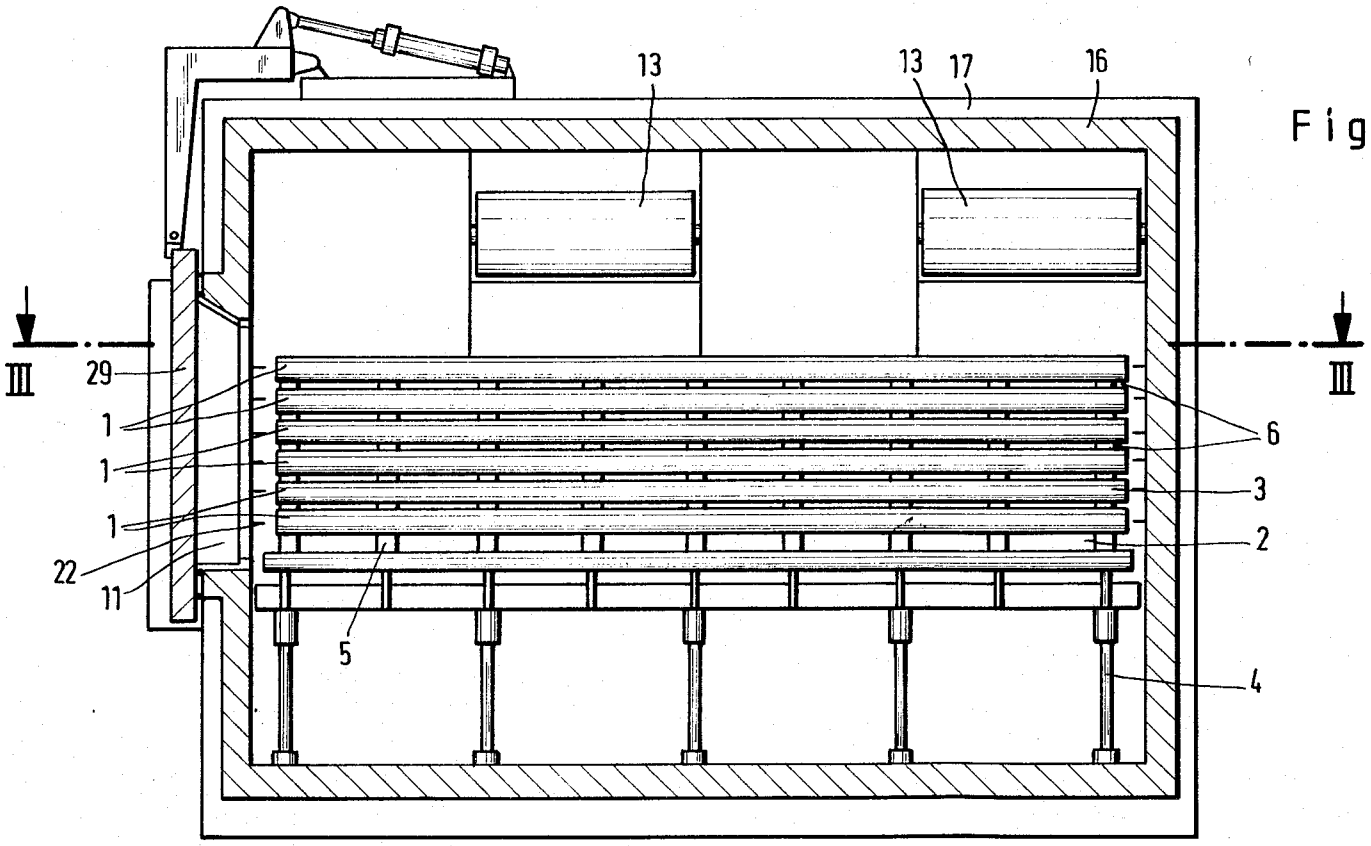
FIG. 2 is a longitudinal-sectional view taken along the line II—II of FIG. 1 in the direction of the arrows.
Figure 3:
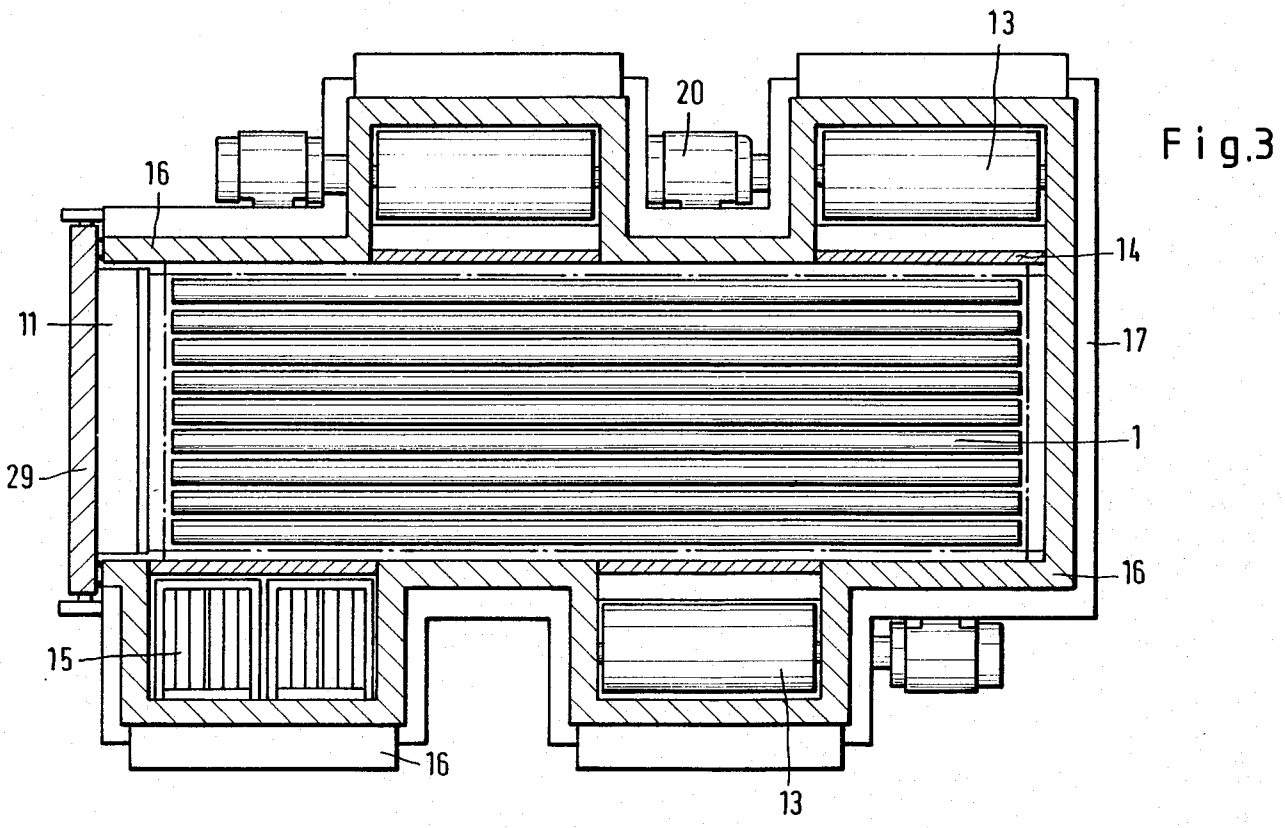
FIG. 3 is a horizontal-sectional view taken along the line III—III of FIG. 2 in the direction of the arrows.

Referring now to the figures of the drawing as a whole, it is seen that in the chamber oven chosen as the embodiment, the recirculated air is pushed through the charge from above. It should already be pointed out at this juncture that the invention can also be applied to ovens with longitudinal circulation of the air. A charge 1 to be treated is located in the treatment space 2 and in the chosen embodiment is formed of cast or extruded round aluminum billets 3, as can be seen particularly well from FIGS. 4 to 6. The billets 3 are desposited by means of a non-illustrated transport device on a grid rack 4 disposed in the oven. The individual round aluminum billets 3 are stacked on a support 5 which is deposited by the transport device on the grid rack 4 or on another rest in the oven, by inserting respective spacers 6. The charge 1 is inserted into the oven for homogenization and is removed from the oven after the heat treatment. Practice has shown that a gap 8 between the charge 1 and the fixed inside walls 7 of the oven must be about 100 mm. A gap of this size is made necessary by inaccuracies in transport, tolerances in the construction of the oven and in the stacking of the material to be treated, deformations of the internal parts of the oven and expansion of the charge (in the embodiment example shown, thermal expansion in the direction of the width of about 30 mm occurs). For economic reasons, on the other hand, the gap 9 between the individual round aluminum billets 3 should be substantially smaller than 100 mm; about 48 mm in the present case. Through this difference in the gap size, different flow resistances are obtained of necessity and therefore different flow velocities are obtained as well, and as a result the heat supply at the lateral surfaces of the charge is considerably larger than in the charge itself.

The air flow velocity at the material to be heated is responsible, among other things, for the heat transfer factor from the air to the material to be heated. This is important for determining the rate at which heating-up occurs. If high temperature uniformity even during the heating-up process is required, care must be taken to see to it that the flow velocities of the air at the individual work pieces are the same, as far as possible. In the chosen construction, with a space having a low flow velocity in front of and behind the charge, this requires the flow resistance for the air paths within the charge, which are parallel to the flow direction, and between the charge and the oven wall, to be approximately equal.

As already mentioned, the distance between the wall and the lateral boundary of the material stack must not fall below a certain value for mechanical reasons.

The elements influencing the air flow in the space between the charge and the oven walls according to the invention, such as obstacles, baffles or the like, cause the flow resistance in this space to be increased very considerably without substantially reducing the clearance between the lateral surface of the charge and the oven wall.

The flow conditions at the side of the door and at the back wall of the oven are even worse. The positioning of the charge is considerably more difficult and a gap 10 of about 200 mm at the rear wall and at the side of the door must be included in the calculation. During the heat treatment, the longitudinal expansion 12 of the round aluminum billets 3 is about 100 mm, which in some circumstances may only occur on one side. In order to avoid the use of a detrimental door collar or neck on the side of the door, the door is usually equipped with a very expensive and complicated kinematic system for opening. In addition, a so-called knapsack 11 is disposed on the inside of the door in order to make the gap between the inside 29 of the door and the charge as small as possible.

Figure 4:
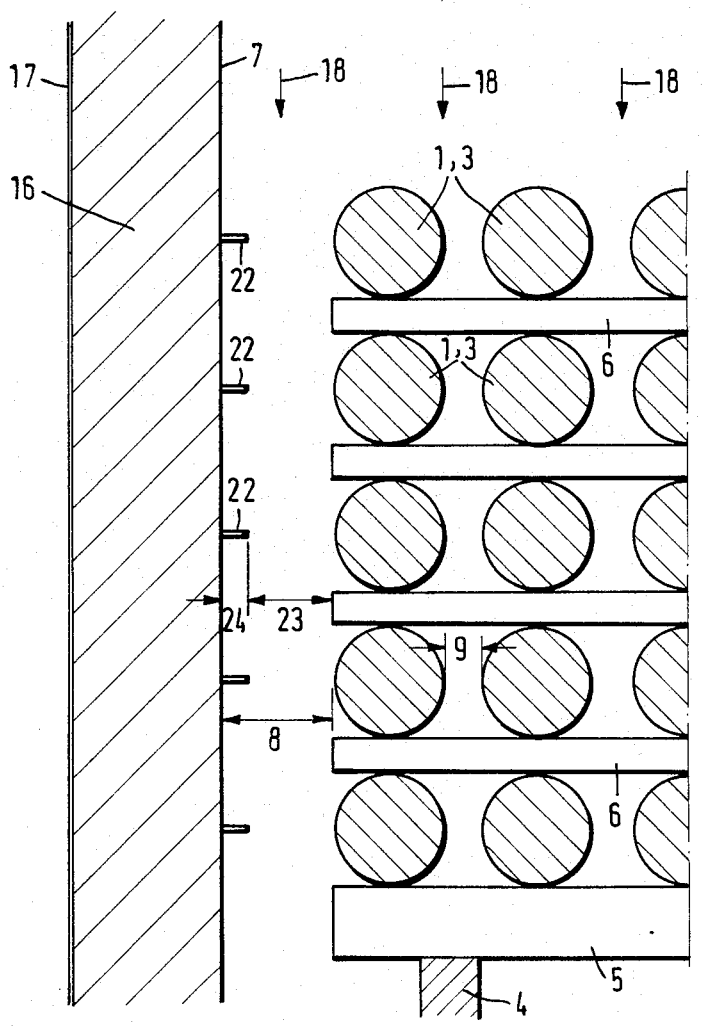
FIG. 4 is an enlarged view of the area designated with reference numeral IV in FIG. 1.

In the construction shown, the recirculated air is pushed through the charge by four blowers 13 and is drawn in through an electric heating device 15 or a gas-operated heating device. As may be seen from FIG. 1, the treatment space 2 is only separated from the blowers 13 and the electric heating system 15 by a partition 14 which, however, need not have insulating properties. On the other hand, in addition to the inner part of the side walls 7, the oven housing is formed of sufficient thermal insulation 16 and an outer oven housing 17. The air flow generated by the blowers 13 is indicated by arrows 18. The air flow emerging downward from the charge 1 is returned to the heating system by deflection elements 19 located underneath the charge. The blowers 13 are driven by electric drive motors 20. Deflection parts 21 which feed the air flow emerging from the blowers 13 to the charge 1, are likewise disposed in the upper part of the oven. FIG. 4 shows a construction according to the invention providing air flow in the space 8 between the inner side wall and elements 22 influencing the charge 1. The distance 23 between the spacers 6 and the elements 22 is to be about 100 mm, while about 50 mm has been chosen for the distance 24 representing the length of the elements 22. Through the use of this structure a spread has been obtained which causes the mean flow velocities in these channels 23 and 9 to still differ by only about 5%. Furthermore, without internal elements influencing the flow and with a distance of 100 mm between the oven wall and the lateral surface of the charge, the flow velocities in this channel 23 are about 1.5 times those in the channels 9 between the rows of bolts. The use of the structure according to the invention therefore amounts to a far-reaching equalization of the mean flow velocities in the different channels, while excellent equalization in the heating-up behavior at the edge and in the center of the charge is obtained due to the heat transfer coefficients which are also approximately equal.

Figure 5:
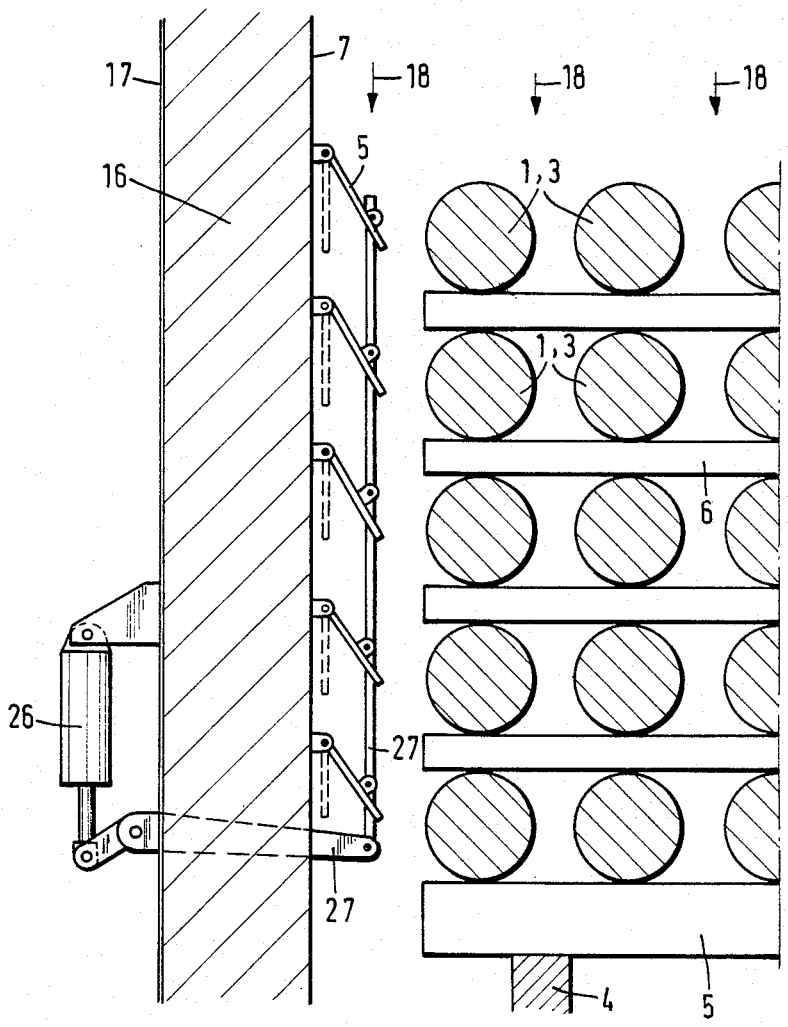
FIG. 5 is another embodiment of the view shown in FIG. 4.
Figure 6:
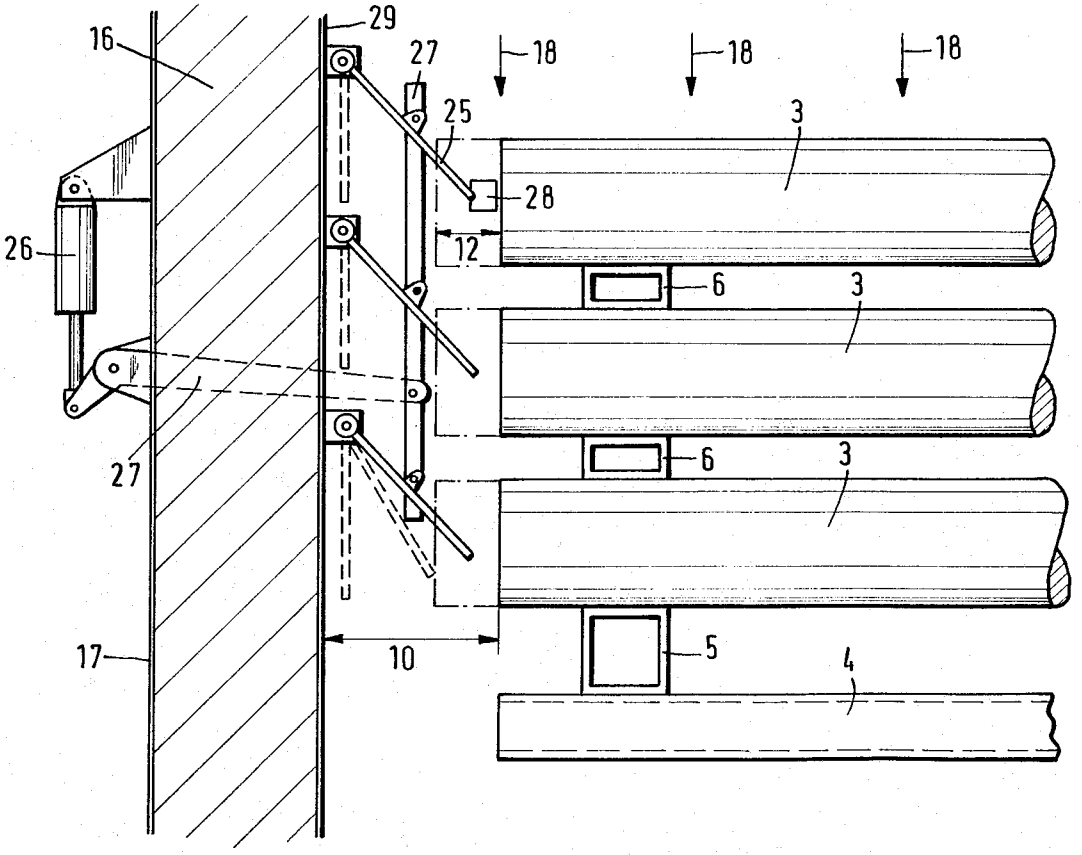
FIG. 6 is a further enlarged view of the area designated with reference numeral IV in FIG. 1.

FIGS. 5 and 6 show another variation of the invention. In this embodiment, the elements are not fixed at the side wall, but flaps 25 which are disposed in louver-fashion, can be set from the outside by a hydraulically or pneumatically operated cylinder 26 and a lever 27, after the charge is inserted into the oven. For very stringent requirements as to the accuracy of the temperature obtained, the flaps can also be adapted to the shape of the components of the charge, so that the same flow conditions as within the charge can be obtained in this case. In the case of round aluminum billets or the flaps 25, respectively, these can have a half-round shape. At the end faces of the aluminum billets, however, it is more practical to leave the flaps straight.

It is particularly advantagenous if stops 28 are disposed at the movable end of the flaps, to ensure a given minimum gap. The drive cylinder 26 is advantageously spring-loaded, so that it can give, in case of thermal expansion of the material to be treated, and the minimum gap can be preserved.

It should further be pointed out that for a different air circulation, the elements in the gap must be disposed in such a way that they are at right angles to the flow direction of the air. For longitudinal circulation of the air, the elements must be vertically oriented.

The foregoing is a description corresponding to German Application P 31 36 667.8, dated Sept. 16, 1981, the International priority of which is being claimed for the instant application and which is hereby made part of this application. Any discrepancies between the foregoing specification and the aforementioned corresponding German application are to be resolved in favor of the latter.

We claim:

1. Industrial oven for heat treatment of a charge having individual components to be treated, comprising:

walls, at least a portion of said walls defining a treatment chamber for receiving the charge;

means for causing air to flow through said chamber in a given air flow direction substantially parallel to at least some of said walls;

means for supporting the charge in said treatment chamber, said supporting means maintaining the charge at a distance from said at least some walls defining a space therebetween, and said supporting means maintaining a mutual spacing between the individual components of the charge permitting said air flow causing means to provide a substantially uniformly distributed given air flow velocity in said given air flow direction between the individual components of the charge; and means in the form of air flow resistance obstacles extended substantially perpendicular to said given air flow direction in said space between the charge and said at least some walls for reducing the velocity of said air flow in said space substantially to said given air flow velocity and for maintaining high temperature uniformity within the charge.

2. Industrial oven according to claim 1, wherein some of said obstacles have a non-planar shape adapted to the shape of non-planar surfaces of the individual components of the charge and others of said obstacles are planar and opposite ends of the individual components of the charge.

3. Industrial oven according to claim 1, wherein said obstacles have a shape adapted to the shape of the charge.

4. Industrial oven for heat treatment of a charge having individual components to be treated, comprising:

walls, at least a portion of said walls defining a treatment chamber for receiving the charge;

means for causing air to flow through said chamber in a given air flow direction substantially parallel to at least some of said walls;

means for supporting the charge in said treatment chamber, said supporting means maintaining the charge at a distance from said at least some walls defining a space therebetween, and said supporting means maintaining a mutual spacing between the individual components of the charge permitting said air flow causing means to provide a substantially uniformly distributed given air flow velocity in said given air flow direction between the individual components of the charge; and means in the form of rigid air flow resistance obstacles extended substantially perpendicular to said given air flow direction in said space between the charge and said at least some walls for reducing the velocity of said air flow in said space substantially to said given air flow velocity and for maintaining high temperature uniformity within the charge.

5. Industrial oven according to claim 4, wherein said rigid obstacles are disposed on said walls opposite ends of the individual components of the charge, and said obstacles have a depth substantially equal to one-third of said distance from the charge to said walls.

6. Industrial oven according to claim 4, wherein some of said obstacles have a non-planar shape adapted to the shape of non-planar surfaces of the individual components of the charge and others of said obstacles are planar and opposite ends of the individual components of the charge.

7. Industrial oven according to claim 4, wherein said obstacles have a shape adapted to the shape of the charge.

8. Industrial oven for heat treatment of a charge having individual components to be treated, comprising:

walls, at least a portion of said walls defining a treatment chamber for receiving the charge;

means for causing air to flow through said chamber in a given air flow direction substantially parallel to at least some of said walls;

means for supporting the charge in said treatment chamber, said supporting means maintaining the charge at a distance from said at least some walls defining a space therebetween, and said supporting means maintaining a mutual spacing between the individual components of the charge permitting said air flow causing means to provide a substantially uniformly distributed given air flow velocity in said given air flow direction between the individual components of the charge; and means in the form of movable air flow resistance obstacles extended substantially perpendicular to said given air flow direction in said space between the charge and said at least some walls for reducing the velocity of said air flow in said space substantially to said given air flow velocity and for maintaining high temperature uniformity within the charge.

9. Industrial oven according to claim 8, wherein some of said obstacles have a non-planar shape adapted to the shape of non-planar surfaces of the individual components of the charge and others of said obstacles are planar and opposite ends of the individual components of the charge.

10. Industrial oven according to claim 8, wherein said obstacles have a shape adapted to the shape of the charge.

* * * * *